United States Patent [19]

Suter

[11] 3,970,004

[45] July 20, 1976

[54] SPINNING PROJECTILE

[75] Inventor: Xaver Suter, Thalwil, Switzerland

[73] Assignee: Werkzeugmaschinenfabrik Oerlikon-Buhrle, Zurich, Switzerland

[22] Filed: Nov. 25, 1974

[21] Appl. No.: 526,750

[30] Foreign Application Priority Data

Dec. 21, 1973 Switzerland ..... 17993/73

[52] U.S. Cl. ..... 102/56 SC; 244/3.23

[51] Int. Cl.[2] ..... F42B 13/10

[58] Field of Search ..... 102/24 HC, 56 SC, 49.3; 244/3.23

[56] References Cited

UNITED STATES PATENTS

| | | | |
|---|---|---|---|
| 2,981,188 | 4/1961 | Lipinski et al. | 102/56 SC |
| 3,002,455 | 10/1961 | Jarnholt | 102/56 SC |
| 3,724,781 | 4/1973 | Makov | 244/3.23 |

*Primary Examiner*—Verlin R. Pendegrass
*Attorney, Agent, or Firm*—Werner W. Kleeman

[57] ABSTRACT

A spinning projectile with a projectile body and a hollow charge component rotatably mounted in the projectile body and axially displaceable by the propellant gases, further including means in order to hold the hollow charge component in its displaced position. According to the invention the aforementioned means are constructed as locking elements which maintain the hollow charge component in the displaced position at the projectile body even after there has been an abatement of the pressure of the propellant charge.

7 Claims, 3 Drawing Figures

SPINNING PROJECTILE

BACKGROUND OF THE INVENTION

The present invention relates to a new and improved construction of spinning projectile with a projectile body and a hollow charge component rotatably mounted in the projectile body and axially displaceable by the propellant gases, and further incorporating means in order to maintain the hollow charge component in the displaced position.

A spinning projectile of this type has become known to the art wherein the gases developed by the propellant charge flow through an annular compartment bounded by two throttle locations and arranged between the projectile body and the hollow charge component. The hollow charge component is displaceable in the axial direction relative to the projectile body in order to produce an equilibrium condition between both throttle locations. In this equilibrium state the propellant gases flowing through the annular compartment form a bearing cushion for the hollow charge component and hold such in the work position. In this manner upon passage of the projectile through the firing barrel or tube there is prevented the spinning entrainment of the hollow charge component owing to friction at surfaces which normally are pressed against one another by the acceleration forces. The aforementioned surfaces however can be pressed against one another during the course of the flight path or trajectory owing to the effective air dynamic pressure or velocity head and the now absent propellant charge pressure, so that finally nonetheless the undesired spinning entrainment of the hollow charge component occurs.

SUMMARY OF THE INVENTION

It is a primary object of the present invention to construct a spinning projectile of the previously mentioned type in such a manner that there can be avoided a spinning entrainment owing to friction upon the occurrence of axial acceleration or deceleration during the entire flight path.

Now in order to implement this object, and others which will become more readily apparent as the description proceeds, the aforementioned means are constructed as locking elements which maintain the hollow charge component in the displaced position at the projectile body even after abatement or yielding of the propellant charge pressure.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
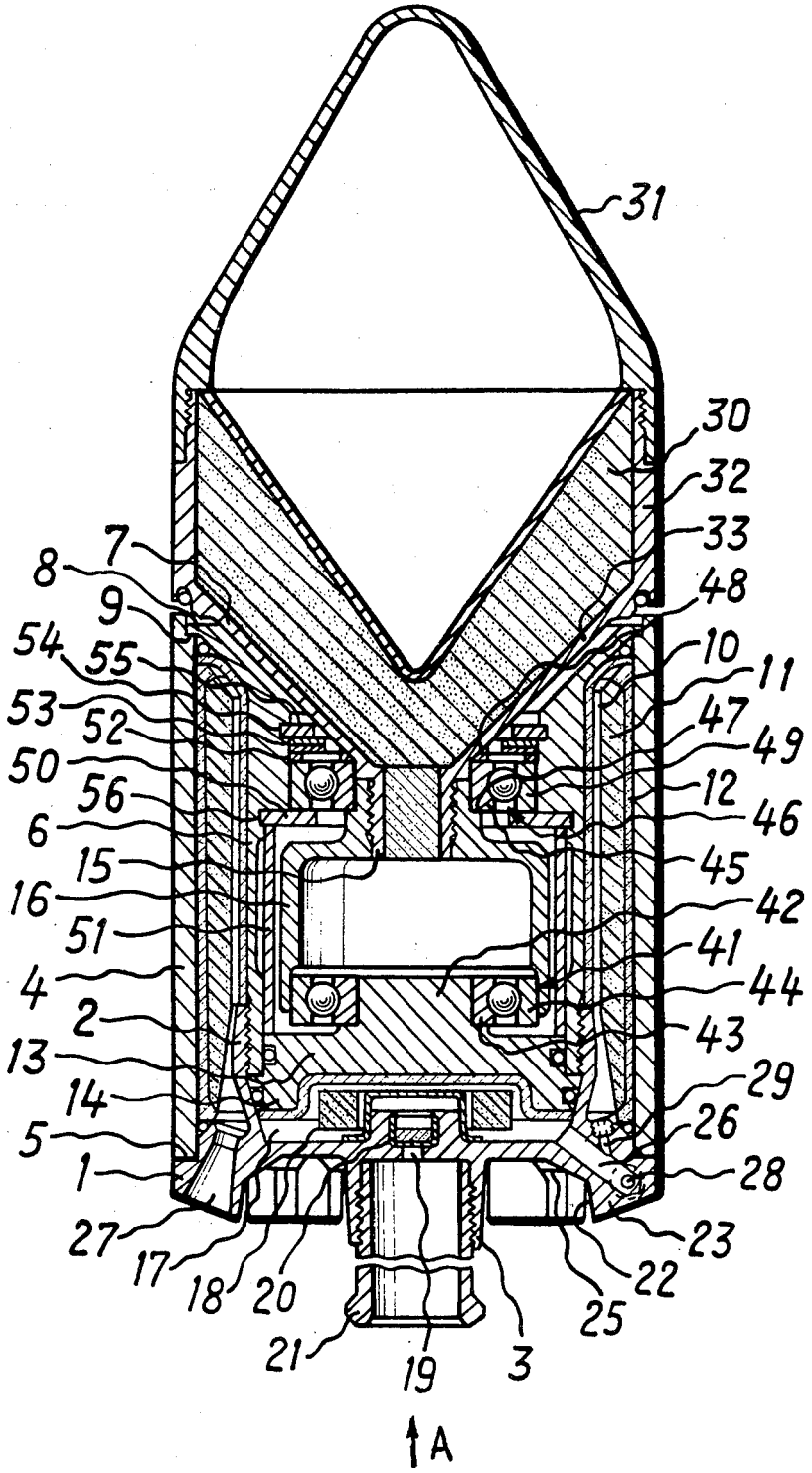
FIG. 1 is a longitudinal sectional view of a spinning projectile designed according to the invention and taken along the line I—I of FIG. 2.

Describing now the drawings, according to the showing of FIG. 1 a floor or base piece 1 possesses two axially forwardly and rearwardly directed sleeve-shaped projections 2 and 3. A cylindrical jacket or shell 4 is centered at the base piece 1 and bears against a shoulder 5 thereof. A sleeve 6 possesses a conical forwardly opening front portion 7 with a flange ring 8. The sleeve 6 extends into the projection 2 of the base piece 1 and is appropriately threadably connected therewith. The rear surface of the flange ring 8 bears upon a shoulder 9 arranged at the inside of the jacket or shell 4. In the annular or ring-shaped compartment forming a combustion chamber or compartment 10 and bounded by the sleeve 6, the shell 4 and the base piece 1 there is arranged a hollow cylindrical propellant charge body 11. This propellant charge body 11 adheres to a layer 12 of a suitable thermally insulating material which has been conveniently applied to the inside of the jacket or shell 4.

A piston 13 is displaceably mounted in the sleeve 6. The piston 13 possesses a hollow cylindrical projection 14. The piston 13 together with projection 14 and the base piece 1 delimit a compartment forming a second combustion chamber 17. In the combustion chamber or compartment 17 there is arranged a propellant charge 18. a firing or detonator cap 20 is inserted in the base piece 1. A bore 19 communicates the detonator cap 20 with the interior of a sleeve 21 which is secured at the projection 3 of the base piece 1.

Figure 2:
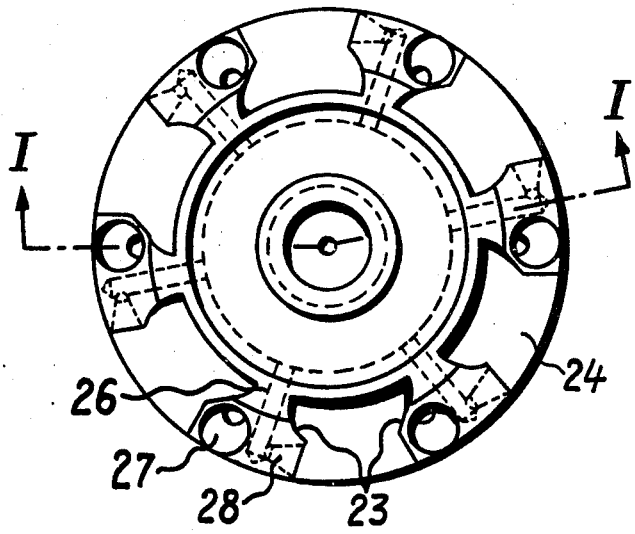
FIG. 2 is a front view looking in the direction of the arrow A of FIG. 1.

The base piece 1 possesses a tapped or cut-in portion 22 machined at the rear side. As best seen by referring to FIG. 2 the base piece 1 possesses six nozzle blocks 23 arranged at a uniform angular spacing from one another and possessing the same spacing from the lengthwise axis of the projectile. The nozzle blocks 23 are separated from one another by milled portions 24 in the annular part of the base piece 1 which surrounds the cut-in portion 22. The milled portions 24 are limited by surfaces 25 directed perpendicular to the projectile axis, the surfaces being located in a plane located behind the shoulder 5. The nozzle blocks 23 possess blindhole bores 26 and nozzles 27, the axes of which constitute the generatrixes of rearwardly opening conical surfaces. The apexes or tips of the conical surfaces are located at the projectile axis with which their axes coincide. The bores 26 communicate the combustion chamber or compartment 17 with nozzles 28, the axes of which are directed perpendicular thereto and are located in a plane. By means of the nozzles 27 the combustion compartment 10 is vented. Bores 29 which communicate with the combustion compartment 10 branch off from the blindhole bores 26.

Figure 3:
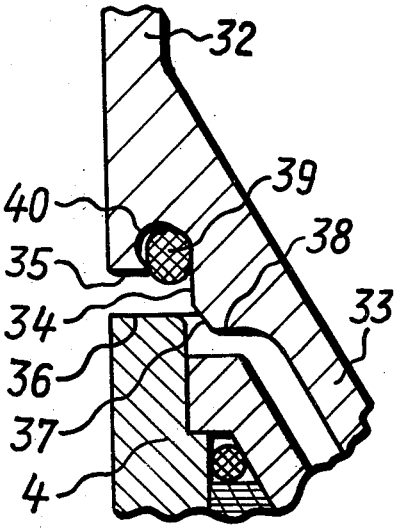
FIG. 3 is a sectional view on an enlarged scale through the separation location between the projectile jacket and the hollow charge component illustrated in a position following firing of the projectile.

A hollow propellant charge 30 is contained in a sleeve 32 possessing a conical hood 31. The sleeve 32 possesses a rearwardly protruding funnel-shaped extension 33. The outer diameters of the sleeve 32 and the jacket or shell 4 are of the same size. According to FIG. 3 the sleeve 32 possesses as the transition to the extension 33 a step-shaped shoulder with two parallel surfaces 35, 36 directed perpendicular to the projectile axis and perpendicular to an end surface 34 of the shell or jacket 4. A forwardly opening conical surface 37 intersects the surface 36 and a cylindrical surface 38, and the diameter of which corresponds to the internal diameter of the jacket 4. A sealing O-ring 39 is inserted in a ring-shaped groove 40 which is cut-in from the location of the surface 35 into the sleeve 32.

The conical extension 33 of the projectile sleeve 32 merges towards the rear into a sleeve-shaped projection 15. Threadably connected with the projection 15 is a sleeve 16 which is stepped in diameter. The sleeve 16 fixedly connected with the hollow charge component or part bears through the agency of a first, rear roller bearing 41 at the piston 13. For this purpose the piston 13 possesses a forwardly tapered, cylindrical projection 42 onto which there is mounted the inner race or ring 43 of a roller bearing 41. The outer ring or race 44 of the roller bearing 41 bears against the inner wall of the sleeve 16. The inner race 45 of second forwardly situated roller bearing 46 bears axially towards the rear at a shoulder 47 at the outside of the tapered front portion of the sleeve 16. Towards the front the inner race 45 of the roller bearing 46 bears via a ring web 48 at the conical extension 33 of the sleeve 32. The inner race 45 is thus connected so as to be axially non-displaceable with the hollow charge component. The outer race 49 of the roller bearing 46 is axially displaceably guided in the projectile body-fixed sleeve 6. It bears towards the rear via a spring or resilient ring member 50 and a bushing 51 at the piston 13 and towards the front via a ring 52 and a package or set of springs 53 at a spring or resilient ring 55 which engages in the annular or ring-shaped groove 54 ln the sleeve 6. In the axial direction of movement there is arranged in front of the spring or resilient ring 50 a further annular or ring-shaped groove 56 in the inner wall of the sleeve 6.

The mode of operation will be apparent from the aforedescribed construction.

For firing purposes the spinning projectile together with its sleeve 21 is placed upon a not particularly illustrated mandrel of a conventional firing mechanism. A likewise not illustrated firing pin pierces the firing or detonator cap 20. The ignition jet emanating from the detonator cap 20 ignites the propellant charge 18. By virtue of the gases resulting from the combustion of the propellant charge 18 the piston 13 is driven. This piston 13 thus displaces via the bushing 51 and the spring ring 50 the front bearing 46 and thus the hollow charge component towards the front and which consists of the sleeve 32 with the hollow charge 30 and the extension 33 as well as the sleeve 16. This movement occurs against the force of the package of springs 53 which in the rest position or state sealingly presses the hollow charge component at the projectile body. When the spring ring 50 is at the height of the annular groove 56 then it snaps into such groove and thereby limits the path of the piston 13 and the hollow charge component towards the front. At the end of this movement the sealing O-ring 39 and the surfaces 35 and 36 of the sleeve 32, as best seen by referring to FIG. 3, possess a spacing from the surface 34 of the jacket or shell 4.

The gases flow through the bores 26 and the nozzles 27 out of the combustion compartment 17. Consequently, tangential forces are exerted, which place the projectile into rotation or spin about its lengthwise axis, so that it initially only rotates upon the not particularly shown mandrel without placing into rotation the hollow charge component. At the same time gas flows through the bores 29 into the combustion compartment 10 and ignites the propellant charge body 11 shortly prior to the completion of the combustion of the propellant charge 18. Owing to the component of the thrust force which acts in axial direction, and which has been produced by the efflux of the gases out of the thrust nozzles 27, the projectile is now accelerated and moved away from the mandrel. The gases of the propellant charge 11 also flow through the bores 29 into the combustion compartment 17, so that the piston 13 during the entire time when the projectile is accelerated, together with the hollow charge component, is held in its advanced position. Since with the exception of the very small frictional forces transmitted by the roller bearings 41, 46 no other forces rotatably engage at the hollow charge component, the latter -- in contrast to conventional projectiles -- only carries out a very slow rotation about its axis.

After completion of combustion of the propellant charge 11 the spring ring 50 which has snapped into the annular or ring-shaped groove 56 prevents that the projectile, under the action of that inertia force which engages thereat owing to the deceleration brought about by the air resistance, can again approach the hollow charge component.

The invention has previously been described on the basis of a rocket spinning projectile, but however it is also to be understood that it is not limited to rocket spinning projectiles. Also in the case of cannon ammunition the principles of the invention can be employed. In such instance the propellant charge gases, which are present owing to burning of the propellant charge located in the cartridge sleeve, are permitted to act directly from the rear at the projectile body and the hollow charge component arranged displaceably therein. When the rifling grooves of the firing barrel for instance produce a progressive spin or twist, it is possible to separate the surfaces between the projectile body and the hollow charge component which previously where in contact, before there occurs a rotation of the projectile, so that also in this case there can be positively prevented with certainty an undesired spinning entrainment of the hollow charge component.

while there is shown and described present preferred embodiments of the invention, it is to be distinctly understood that the invention is not limited thereto, but may be otherwise variously embodied and practiced within the scope of the following claims.

Accordingly, what is claimed is

1. A spinning projectile comprising a projectile body, a hollow charge component rotatably mounted in the projectile body and axially displaceable by propellant gases, means for maintaining the hollow charge component in the displaced position, said maintaining means comprising locking elements which hold the hollow charge component in the displaced position at the projectile body even after abatement of the propellant charge pressure.

2. The spinning projectile as defined in claim 1, wherein the locking elements comprise a spring ring displaceable with the hollow charge component and an annular groove arranged in the projectile body and in the axial direction of movement thereof in front of the spring ring.

3. The spinning projectile as defined in claim 2, further including a front roller bearing and a rear roller bearing for radially supporting the hollow charge component in the projectile body, the front roller bearing having an inner race connected to be axially non-displaceable with the hollow charge component, a piston movable by the action of the propellant gases, the front roller bearing having an outer race bearing towards the rear upon said spring ring and being in driving connection with said piston movable by the action of the propellant gases.

4. The spinning projectile as defined in claim 3, further including a package of springs arranged between the outer race of the front roller bearing and a stop fixed at the projectile body and located in front of said outer race.

5. The spinning projectile as defined in claim 3, further including a sleeve provided for the projectile body, said sleeve being tapered in relation to the diameter of the projectile, and the front roller bearing being guided in said tapered sleeve.

6. The spinning projectile as defined in claim 3, including a forwardly extending tapered cylindrical projection provided for the piston, a sleeve having an inner wall and connected with the hollow charge component, and wherein the rear roller bearing is arranged between the forwardly extending tapered cylindrical projection of the piston and the inner wall of said sleeve connected with the hollow charge component.

7. The spinning projectile as defined in claim 3, further including a sleeve provided for the projectile body, said sleeve being tapered with respect to the diameter of the projectile, the front roller bearing being tuided in said sleeve, said sleeve of the projectile body being sealed towards the rear by a base piece, said sleeve and said base piece together with said piston forming a combustion compartment for a spinning-propellant charge of a rocket projectile.

* * * * *